US008306724B2

(12) United States Patent
Price et al.

(10) Patent No.: US 8,306,724 B2
(45) Date of Patent: Nov. 6, 2012

(54) AIR TRAFFIC CONTROL

(75) Inventors: Adrian John Price, Hampshire (GB); William Casey, Hampshire (GB)

(73) Assignee: Nats (En Route) Public Limited Company, London (GB)

( * ) Notice: Subject to any disclaimer, the term of this patent is extended or adjusted under 35 U.S.C. 154(b) by 708 days.

(21) Appl. No.: 12/306,916

(22) PCT Filed: Jun. 29, 2007

(86) PCT No.: PCT/GB2007/002459
§ 371 (c)(1),
(2), (4) Date: Sep. 29, 2009

(87) PCT Pub. No.: WO2008/001122
PCT Pub. Date: Jan. 3, 2008

(65) Prior Publication Data

US 2010/0030457 A1 Feb. 4, 2010

(30) Foreign Application Priority Data

Jun. 30, 2006 (GB) ..... 0613054.6

(51) Int. Cl.
*G08G 5/04* (2006.01)

(52) U.S. Cl. ..... 701/120; 701/300; 701/301; 701/16; 701/436

(58) Field of Classification Search ..... 701/120–122, 701/300, 301, 14–16, 4, 10, 11, 408, 422, 701/428, 436
See application file for complete search history.

(56) References Cited

U.S. PATENT DOCUMENTS

| | | | |
|---|---|---|---|
| 4,949,267 | A | 8/1990 | Gerstenfeld et al. |
| 5,714,948 | A | 2/1998 | Farmakis et al. |
| 6,393,358 | B1 | 5/2002 | Erzberger et al. |
| 6,604,044 | B1 | 8/2003 | Kirk |
| 6,785,594 | B1 | 8/2004 | Bateman et al. |

(Continued)

FOREIGN PATENT DOCUMENTS

EP 0380460 A2 8/1990

(Continued)

OTHER PUBLICATIONS

International Search Report and Written Opinion from GB2006/004850.

P. Whysall: Future Area Control Tools Support (FACTS), 2nd USA/Europe Air Traffic Management R&D Seminar, Dec. 1998, pp. 1-10, XP002423982, Orlando, FL.

A. Price: Future Area Control Tools Support Operational Concept and Development Status, FAA/EURO Control AP6 TIM, Oct. 1999, pp. 109, XP002423983, Memphis, USA.

(Continued)

*Primary Examiner* — Richard M. Camby
(74) *Attorney, Agent, or Firm* — Procopio, Cory, Hargreaves & Savitch LLP

(57) ABSTRACT

An air traffic control system, for use by a controller controlling a plurality of aircraft held vertically separated in a stack, the system comprising at least one processor; a display device for the control generating a display controlled by said at least one processor, and at least one device for selectively receiving, from said aircraft, an indication of their intended future altitudes; in which said processor is arranged to receive such intended altitude data; to compare said intended altitude data with current altitude and/or intended altitude data of other aircraft; and to generate said display on said display device so as to list said plurality of aircraft, to highlight a first part of the display relating to a first aircraft whose intended altitude overlaps with the current or intended altitude of at least one said second aircraft, and to highlight also a second part of the display relating to said second aircraft.

7 Claims, 9 Drawing Sheets

U.S. PATENT DOCUMENTS

| | | | | |
|---|---|---|---|---|
| 7,248,949 | B2 * | 7/2007 | Love et al. | 701/4 |
| 8,090,525 | B2 * | 1/2012 | Villiers | 701/120 |
| 2003/0200024 | A1 | 10/2003 | Poreda | |
| 2007/0032940 | A1 | 2/2007 | Villiers | |

FOREIGN PATENT DOCUMENTS

| | | | |
|---|---|---|---|
| EP | 0598154 | A1 | 5/1994 |
| EP | 1450331 | A1 | 8/2004 |
| FR | 2854978 | A1 | 11/2004 |
| WO | WO8801086 | A2 | 2/1988 |
| WO | WO03067545 | A1 | 8/2003 |
| WO | WO2004102505 | A2 | 11/2007 |

OTHER PUBLICATIONS

International Search Report and Written Opinion for PCT/GB2006/004873.

ATC Training: NATS Looks to the Future, article published sometime before Nov. 10, 2005, available at the following URL: http://www.airport-int.com/categories/atc-training/atc-training-nats-looks-to-future.asp.

International Search Report and Written Opinion from PCT/GB2007/002459 issued Sep. 20, 2007.

International Search Report and Written Opinion from PCT/GB2007/002449 issued Sep. 20, 2007.

* cited by examiner

AIR TRAFFIC CONTROL

This invention relates to computerised systems for aiding air traffic control, and particularly to systems providing user interfaces for assisting controllers to visualise and control aircraft in a vertical stack.

Air traffic control involves human staff communicating with the pilots of a plurality of aircraft, instructing them on routes so as to avoid collisions. Aircraft generally file "flight plans" indicating their routes before flying, and from these, the controllers have some initial information on the likely presence of aircraft, but flight plans are inherently subject to variation (due, for example, to delays in take offs; changes of speed due to head wind or tails wind; and permitted modifications of the course by the pilot). In busy sectors (typically, those close to airports) active control of the aircraft by the controllers is necessary.

The controllers are supplied with data on the position of the aircraft (from radar units) and ask for information such as altitude, heading and speed. They instruct the pilots by radio to maintain their headings, alter their headings, in a predetermined fashion, or maintain or alter their altitudes (for example to climb to a certain altitude or to descend to a certain altitude) so as to maintain safe minimum separation between aircraft and, thus, to avoid the risk of collisions. Collisions are extremely rare, even in the busiest areas, due to the continual monitoring and control of aircraft by the air traffic controllers, for whom safety is, necessarily, the most important criterion.

On the other hand, with continual growth of air transportation, due to increasing globalised trade, it is important to maximise the throughput of aircraft (to the extent that this is compatible with safety). Further increasing throughput with existing air traffic control systems is increasingly difficult. It is difficult for air traffic controllers to monitor the positions and headings of too many aircraft at one time on conventional equipment, and human controllers necessarily err on the side of caution in separating aircraft.

One tool used for air traffic control is a vertical stack. At busy airports, it may be necessary to hold an aircraft temporarily before it can land. An area of airspace close to the airport may therefore be designated as a stack. The air traffic controller has, at any time, a number of aircraft in the stack of which some are in a holding pattern, others are entering the air space, and other are exiting the air space. Additionally, some aircraft will be instructed to descend from the stack to land. For those aircraft held in the stack prior to landing, the air traffic controller will usually "ladder" the aircraft down; that is, instruct the lowest in the stack to land, then descend the remaining aircraft within the stack to occupy the unoccupied levels (in a first-in first-out arrangement like a pipeline).

For aircraft in transit, it is conventional to refer to "flight levels" rather than altitudes. A flight level corresponds to the altitude (expressed in units of hundreds of feet) above sea level which the aircraft would occupy, on the basis of its altimeter reading, relative to a reference pressure of 1013 millibars. Flight levels therefore form concentric isobaric surfaces spaced from one each another like the layers of an onion, and a flight controller can separate aircraft in one area by specifying that they occupy different flight levels.

In a vertical stack, aircraft are typically kept well separated by allocating each a different flight level. Standard procedures require a separation of 1000 feet between aircraft in a stack. The fact that two aircraft occupy the same flight level does not necessarily mean that they will come close to each other, since they may be separated laterally (i.e. in azimuth).

Nonetheless, vertical separation, where possible, leads to greater safety and requires less active management by the air traffic controller.

Conventionally, in the past, air traffic controllers have utilised paper slips, each representing an aircraft, which can be arranged in an ordered list as a tool to manage aircraft. More recently, the present applicant has introduced display tools for creating a computer display on a controller's workstation which in some respects automate the paper slips, by displaying in a vertical stack a list of the aircrafts which an air traffic controller is controlling.

In addition to aircraft which are added to the stack because they are awaiting landing, the controller needs to be aware of any other aircraft in the vicinity, or which might enter the vicinity. The present applicant has provided a "vertical stack list" program tool which detects the horizontal (i.e. azimuthal) position of aircraft and adds them to a stack associated with an airport when they are within a predetermined volume of airspace and where their flight plans indicate that airport as their destination. The controller may also manually add an aircraft to the vertical stack list where, for example, he thinks it may in future enter the predetermined volume. The stack list is displayed in height order.

Radar monitoring of aircraft has recently been improved with the introduction of so called "Mode-S" (short for Secondary Surveillance Radar (SSR) Mode-Select), as described at www.caa.co.uk/default.aspx?categoryid=810

A Mode-S radar includes an interrogator, and each Mode-S equipped aircraft includes a transponder. When the interrogator interrogates a particular aircraft, its transponder transmits a number of data in reply. These include pressure altimeter readings (accurate down to a minimum increment of 100 feet, or in some cases 25 feet, provided the altimeter reference altitude is correctly set). It is thus possible to obtain selectively, from each aircraft, a current set of instrument readings, free from possible crew reporting errors, more accurately than by the use of radar alone. Each aircraft can therefore be indicated at the altitude corresponding to its measured altitude or flight level, rather than to that detected by radar or reported by the aircrew.

Mode-S Phase 2 or enhanced transponders can also signal pilot intention data such as autopilot settings, including future intended flight levels.

An aim of the present invention is therefore to provide computerised support systems for air traffic control of vertical aircraft stacks which allow human operators to increase the throughput of aircraft without an increase in the risk of losses of minimum permitted separation from its present very low level.

The invention in various aspects is defined in the claims appended hereto, with advantages and preferred features which will be apparent from the following description and drawings.

Embodiments of the invention will now be illustrated, by way of example only, with reference to the accompanying drawings in which.

GENERAL DESCRIPTION OF AIR TRAFFIC CONTROL SYSTEM

Figure 1:
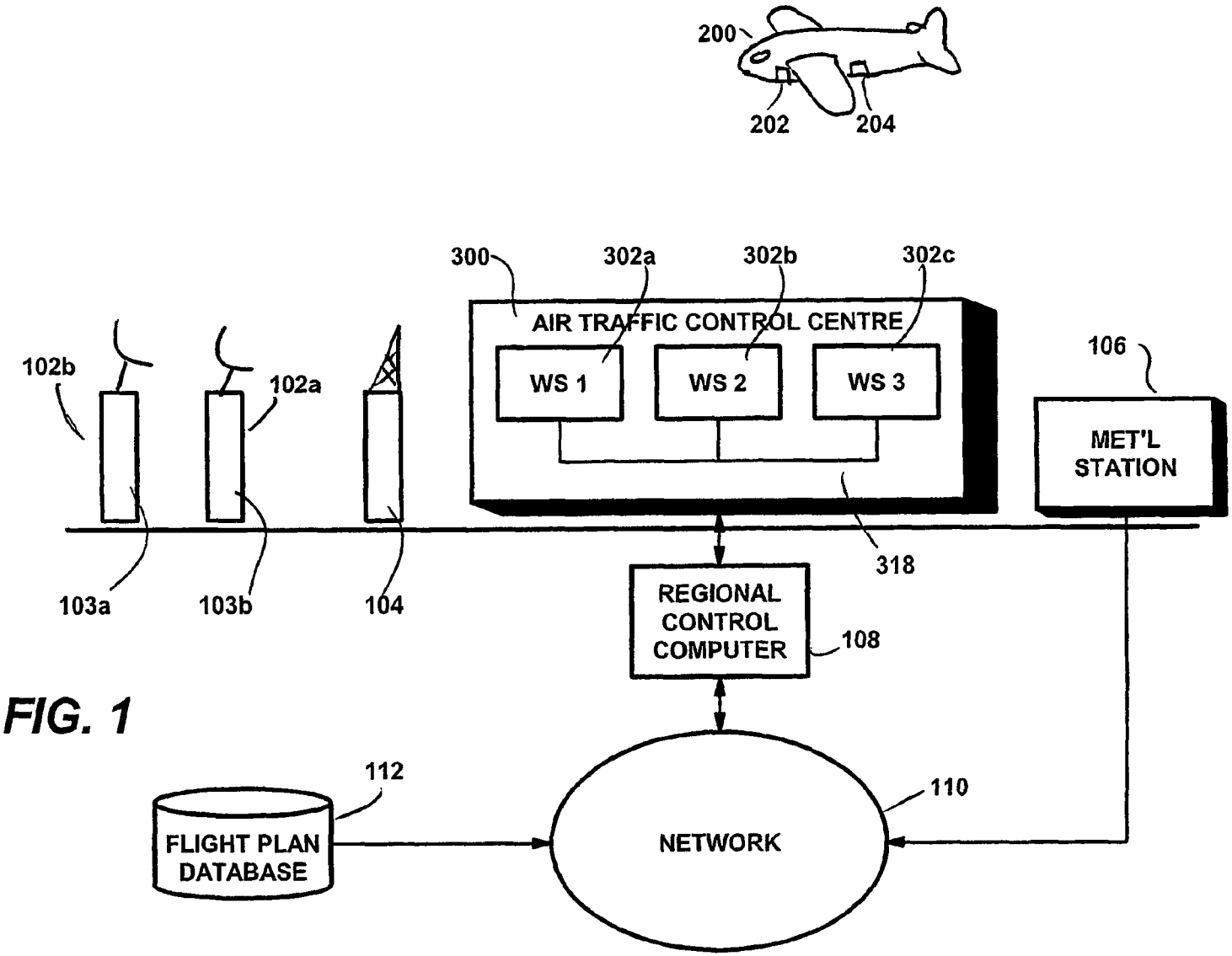
FIG. 1 is a block diagram showing an air traffic control system for a sector of airspace in accordance with an embodiment of the invention.

FIG. 1 shows the hardware elements of an air traffic control system (known per se, and used in the present embodiments). In FIG. 1, a radar tracking system, denoted 102, comprises radar equipment for tracking incoming aircraft, detecting bearing and range (primary radar) and altitude (secondary radar), and generating output signals indicating the position of each, at periodic intervals. It comprises first and second radar stations 102*a*, 102*b* each also equipped with a respective interrogator 103*a*, 103*b* for interrogating aircraft for Mode-S data.

A radio communications station 104 is provided for voice communications with the cockpit radio of each aircraft 200. Each aircraft comprises instruments 202 including an altimeter and an autopilot, and a Mode-S transponder 204 connected thereto and arranged to downlink instrument data therefrom.

A meteorological station 106 is provided for collecting meteorological data including local air pressure and outputting pressure measurements (and forecasts of wind, speed and direction, and other meteorological information). A server computer 108 communicating with a communication network 110 collects data from the radar system 102 and (via the network 110) the meteorological station 106, and provides the collected data to an air traffic control centre 300.

Data from the air traffic control centre 300 is, likewise, returned to the server computer for distribution through the network 110 to air traffic control systems in other areas.

A database 112 stores respective records for each of a plurality of aircraft 200, including the aircraft callsign and flight plan.

The airspace for which the air traffic control centre 300 is responsible is typically divided into a plurality of sectors each with defined geographical and vertical limits and controlled by planning and tactical controllers and at least one controller is responsible for at least one vertical stack of aircraft.

The air traffic control centre 300 comprises a plurality of workstations for controllers 302*a*, 302*b*, . . . . Each controller receives flight plan data regarding the aircraft located in (and scheduled to enter) his sector from the database 112. Amongst other tasks, the controller is arranged to manage a vertical stack of aircraft 200*a*, 200*b*, . . . .

Figure 2:
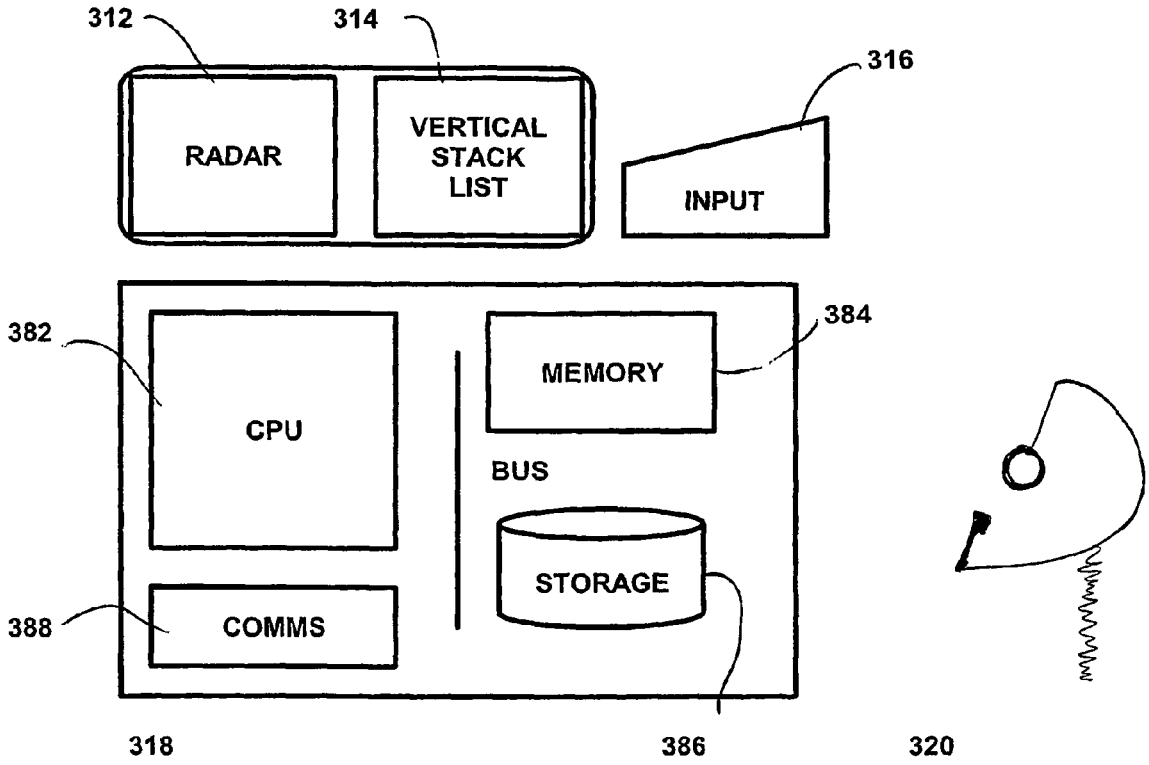
FIG. 2 is a block diagram showing the elements of a workstation forming part of FIG. 1.

Referring to FIG. 2, each workstation 38 comprises a CPU 382, memory 384, storage (e.g. a disc hard array) 386 and a communications interface 388. A local area network 308 interconnects all the workstation computers 318 with the server computer 108.

Figure 3:
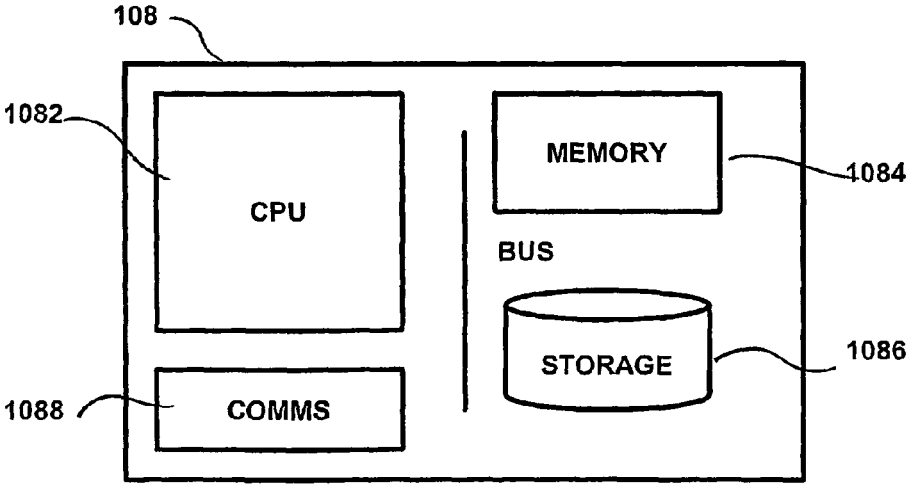
FIG. 3 is a block diagram showing the elements of a central computer forming part of FIG. 1.

Referring to FIG. 3, the server computer 108 comprises a CPU 1082, memory 1084, storage (e.g. a disc hard array) 1086 and a communications interface 1088. The server computer distributes data to the terminal workstation computers 318, and accepts data from them entered via the keyboard 316.

Referring to FIG. 2, each work station 302 comprises a radar display screen 312 which shows a conventional plan (e.g. radar-type) view of the air sector, with the sector boundaries, the outline of geographical features such as coastline, the position and surrounding airspace of any airfields. Superimposed is a dynamic display of the position of each aircraft received from the radar system 102, together with the call sign or flight number (an alphanumeric indicator) of that aircraft. The tactical controller is therefore aware, at any moment, of the position of the aircraft in the sector. A headset 320 comprising an ear piece and microphone is connected with the radio station 104 to allow the controller to communicate with each aircraft 200.

A visual display unit 314 is also provided, on which a computer workstation 318 can cause the display of one or more of a plurality of different display formats, under control of the controller operating the keyboard 316 (which comprises a standard QWERTY keyboard and pointing device).

DESCRIPTION OF THE PREFERRED EMBODIMENTS

Figure 4:
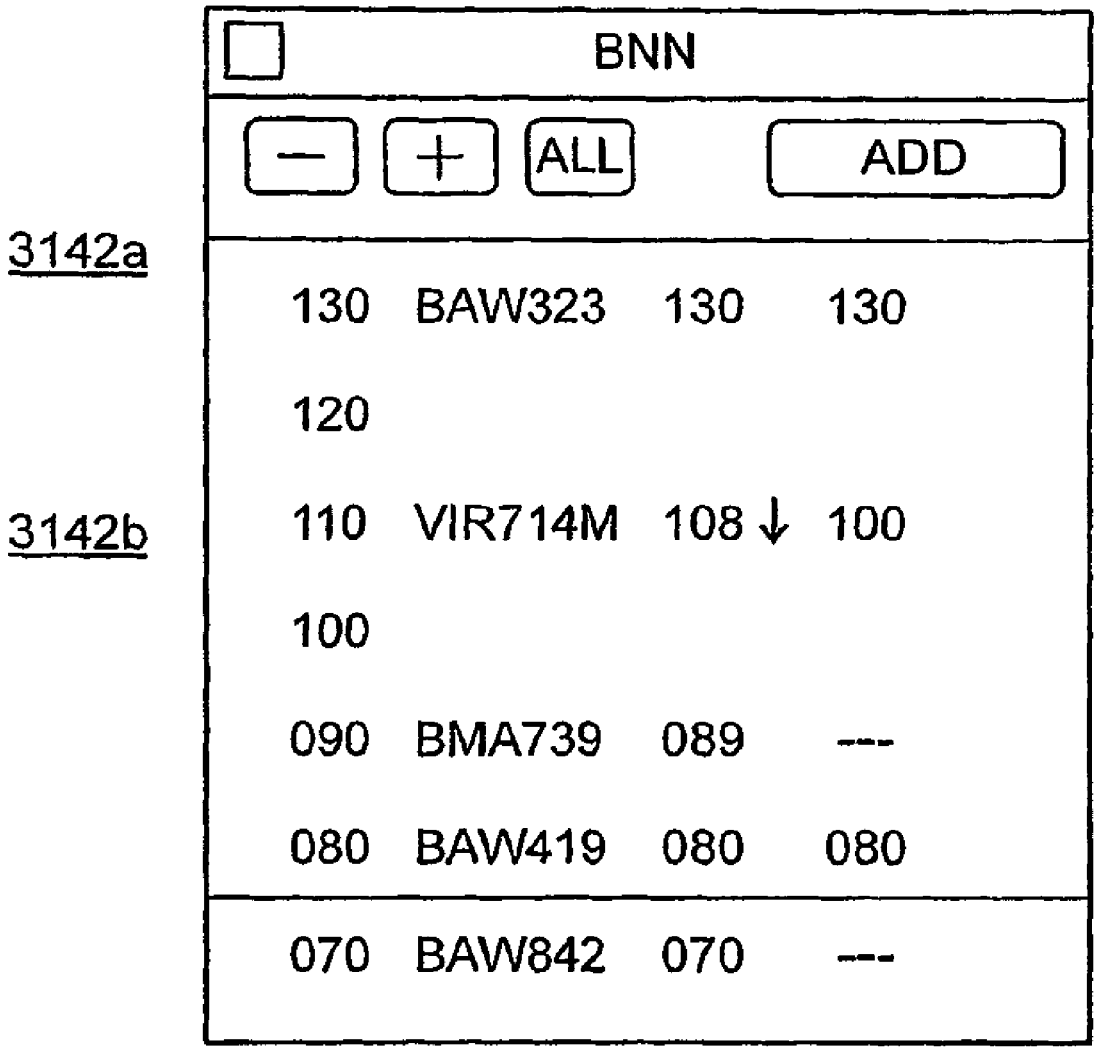
FIG. 4 is a screen display produced according to a preferred embodiment.

Referring to FIG. 4, a display shown on the screen 314 is shown. It comprises a vertical stack list of aircraft held in the stack by the controller operating the workstation. The list comprises a plurality of vertically-arranged horizontal slots 3142*a*, 3142*b* . . . . Each slot is centred at a respective flight level and has a vertical extent representing 1000 feet. It is intended that each be occupied by a single aircraft so that aircraft are separated by at least 1000 feet in altitude.

Each slot contains five display fields which are, from left to right;

- Vertical Stack List level field indicating the flight level (in white numerals);
- Aircraft call sign of any aircraft in that slot;
- Pressure altitude of aircraft, reported in response to interrogation by the radar;
- Ascending/descending arrow to indicate movement of the aircraft based on its current climb or descent;
- Selected Flight Level field indicating the next flight level programmed into the autopilot by the aircrew, reported in response to interrogation by the radar.

The weather station 106 periodically measures the air pressure and the radar stations 102*a*, 102*b* periodically (e.g. of the order of every 10 seconds, for example every 4 seconds) interrogate each aircraft 200. Thus, the update frequency for each aircraft is higher than the update rate of each individual radar station, depending on the number of radar stations.

Figure 5:
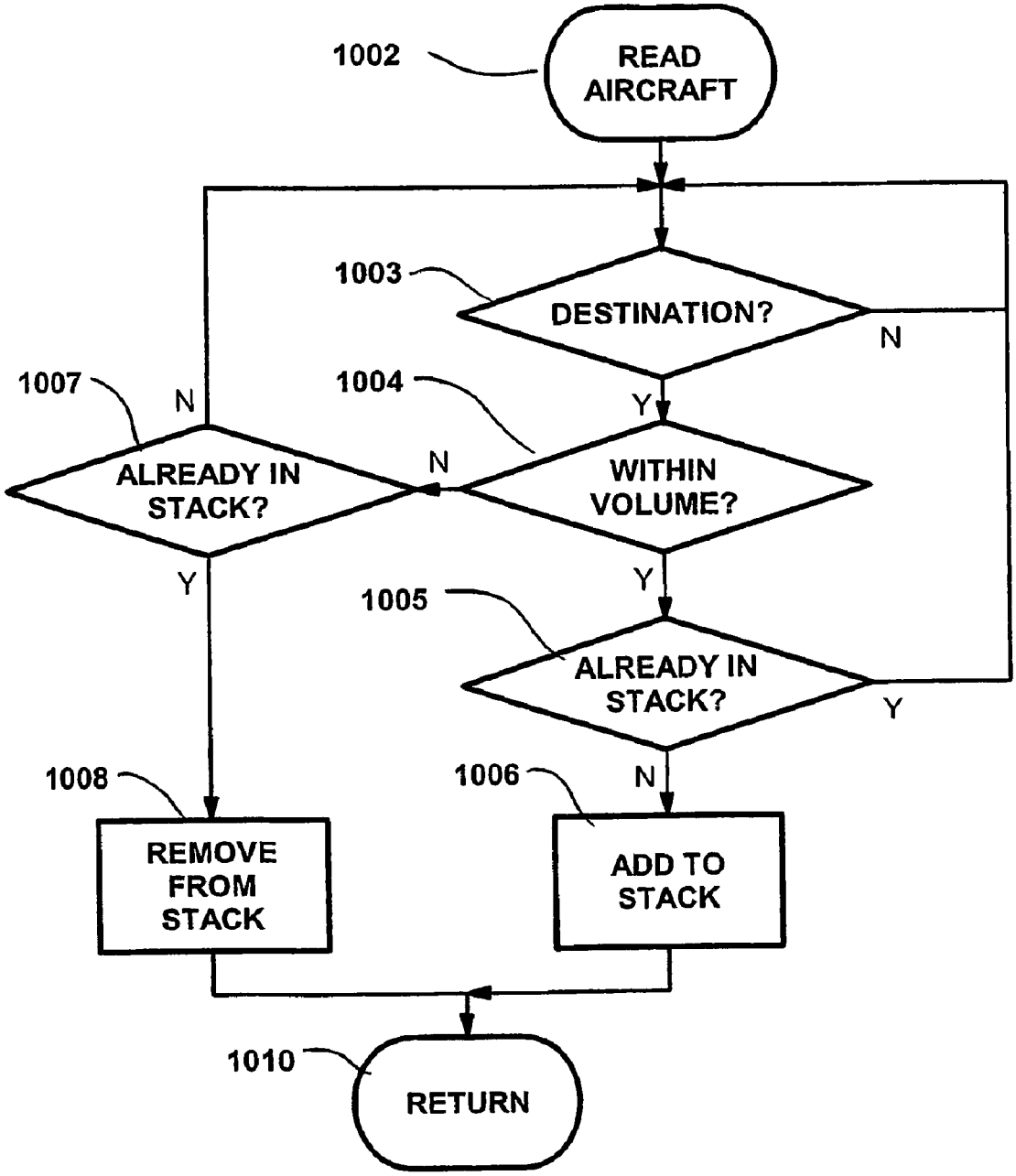
FIG. 5 is a flow diagram showing the process of automatically populating a stack list, performed by the preferred embodiment to produce the display of FIG. 4.

Referring to FIG. 5, in this embodiment, the stack list display is created and periodically updated. In step 1002, each detected aircraft is checked and in step 1004 its destination (stored in the database 112) is tested. In step 1003 the position of the aircraft is tested and, for those falling within a defined airspace volume (step 1004), and for which a record is not already held in a stack list record held in the computer 108 (step 1005), a record is created and added to the list (step 1006). The defined volume may for example be defined, in azimuth, by a 15 nautical mile radius from a predetermined stack reference point, and by upper and lower stack levels.

Aircraft falling within the defined volume are thus added to the stack list automatically when they enter the predefined volume. Aircraft may also be added to the stack list manually by the controller operating a workstation 302 by actuating an "ADD" button (shown in FIG. 4) and selecting an aircraft to add from the plan display or typing in its callsign. Each record thus added includes a flag field indicating its type (i.e. whether it was automatically or manually added).

If (step 1004) the aircraft is not inside the defined volume, then (step 1007), the records of aircraft currently in the stack are examined and any which have thus been detected as having left the predefined volume, and for which the flag type is "automatic", have their records deleted from the stack record in step 1008. Those for which the flag type is "manual" can be manually removed by the controller.

Figure 9:
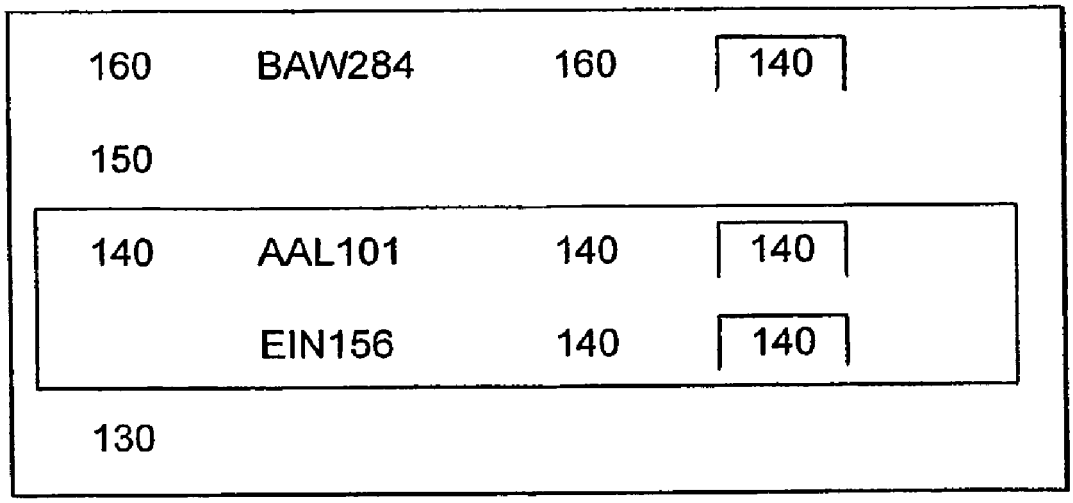
FIG. 9 shows a portion of a screen display corresponding to that of FIG. 4 in the case of an aircraft whose intended altitude overlaps with that of two others both at the same altitude.

In step 1012, a new altitude ("current flight level") of an aircraft is read via a radar station, and passed to the computer 108. In step 1013, the computer 108 is arranged to examine all aircraft records in the stack and sort them in order of altitude. In step 1014, the workstation 302 accesses the stack list and displays the vertical stack list. The aircraft (indicated by their respective call signs) are displayed within their slots showing their current flight levels.

Where a slot contains more than one aircraft, they are presented in vertical order, the higher aircraft entry being displayed higher in the slot. If two aircraft have the same altitude, as measured by the transponder (which has a minimum increment of 25 feet), the aircraft which has been at that altitude for the longest is displayed lowest (as it is likely to be descended first). Where two aircraft occupy the same slot in this way, they are indicated, as shown in FIG. 4 or FIG. 9, with a box around them to show that they are at the same altitude.

The aircraft in the stack may have been instructed to maintain the present altitude, or to climb or descend. Equally, if they have not received any instruction, they may voluntarily choose to climb or descend. When changing their flight level, the aircrew enter a new flight level in their autopilot. After some short interval, the aircraft is interrogated by the Mode-S radar, and the downlinked data is relayed to the central processor, and (ultimately) the air traffic controller via the display 314. The time from instructing a new flight level to display on the display 314 may be up to 16 seconds, bearing in mind the time to input the new level, interrogation and so on.

Whilst the controller usually attempts to keep aircraft in a vertical stack separated in altitude (e.g. in slots separated by around 1000 feet of altitude as shown in FIG. 4) there are occasions when, for good reasons, one aircraft needs to pass through the altitude occupied by another. Provided the aircraft are adequately separated in azimuthal position, the controller need not regard such transitions as dangerous. There are also, however, occasions on which an aircraft may intend to descend through the level occupied by another without the certainty of azimuthal separation; either because it has decided to change level on the initiative of the crew, or because, as happens occasionally, the crew misheard an altitude instruction (for example mistaking "flight level 070" for "flight level 170").

Figure 6A:
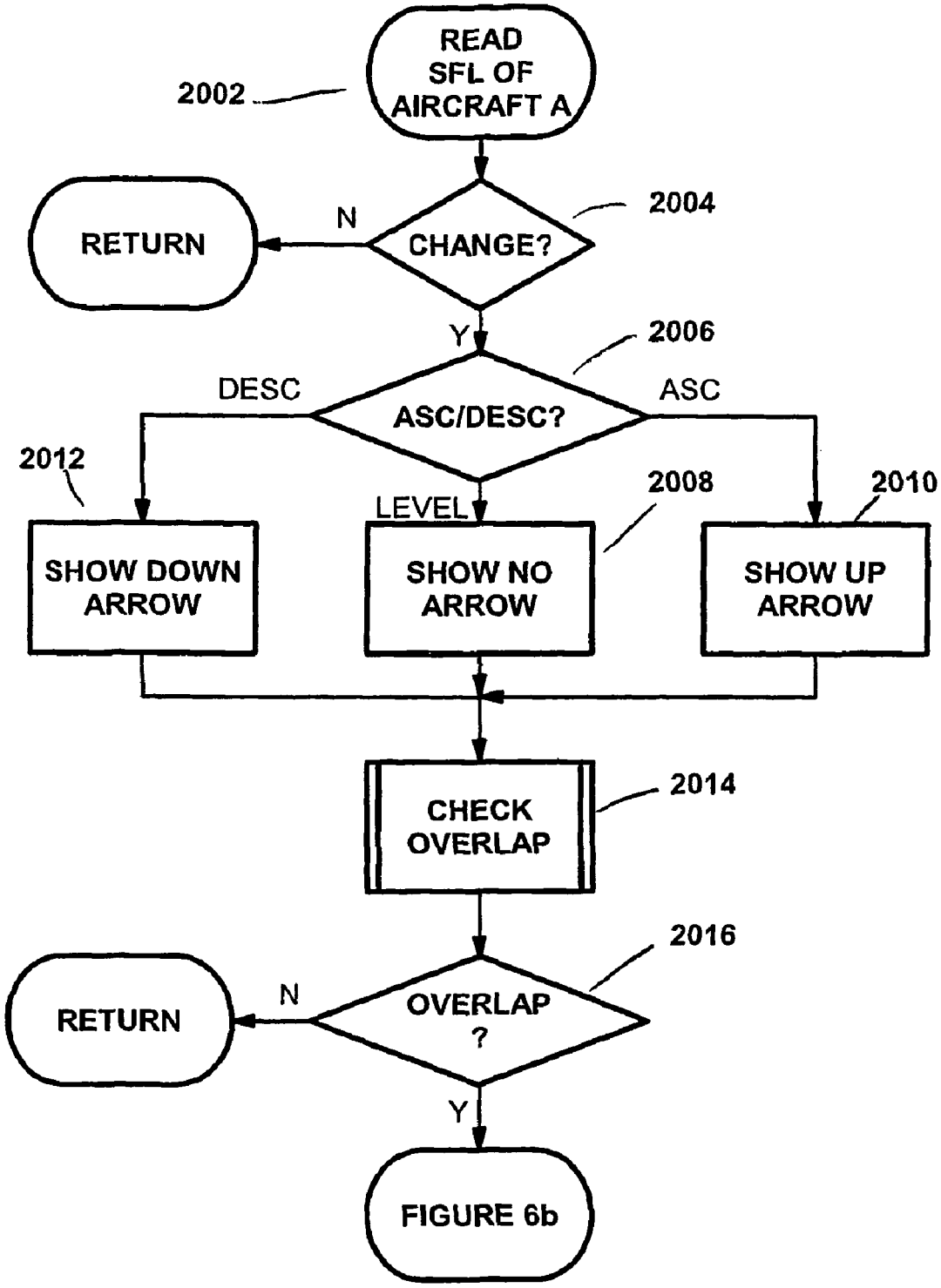
FIG. 6 (comprising FIGS. 6*a* and 6*b*) is a flow diagram showing a process performed by a preferred embodiment in displaying, and updating the display of, aircraft in a vertical stack list to show altitudes that potentially overlap in future.

Referring to FIG. 6, when one of the radar stations 102 acquires a new selected flight level reading from an aircraft, it is supplied to the computer 108 in step 2002. In step 2004, the controller determines whether the reading has changed from the previous selected flight level for that aircraft, and if not, returns to await the next reading.

In step 2006, the computer 108 compares the current flight level (CFL) reading with the previous current flight level (CFL) altitude reading for that aircraft. Where they are the same, the aircraft is in level flight. Where the current flight level is higher than the previous flight level, the aircraft is ascending, and where the current flight level is lower than the previous flight level, the aircraft is descending. Accordingly, where the aircraft is found to be intending level flight at step 2006, then the display generated (shown in FIG. 4) has no arrow next to it in the display field as in slot 3142*a* (step 2008). Where (step 2006) the selected flight level indicates that the aircraft will be ascending, then an upwards pointing arrow is displayed (step 2010). Likewise, where the aircraft is found to be descending in step 2006, it is displayed with a downward pointing arrow (as in slot 3142*b*) in step 2012.

Figure 7:
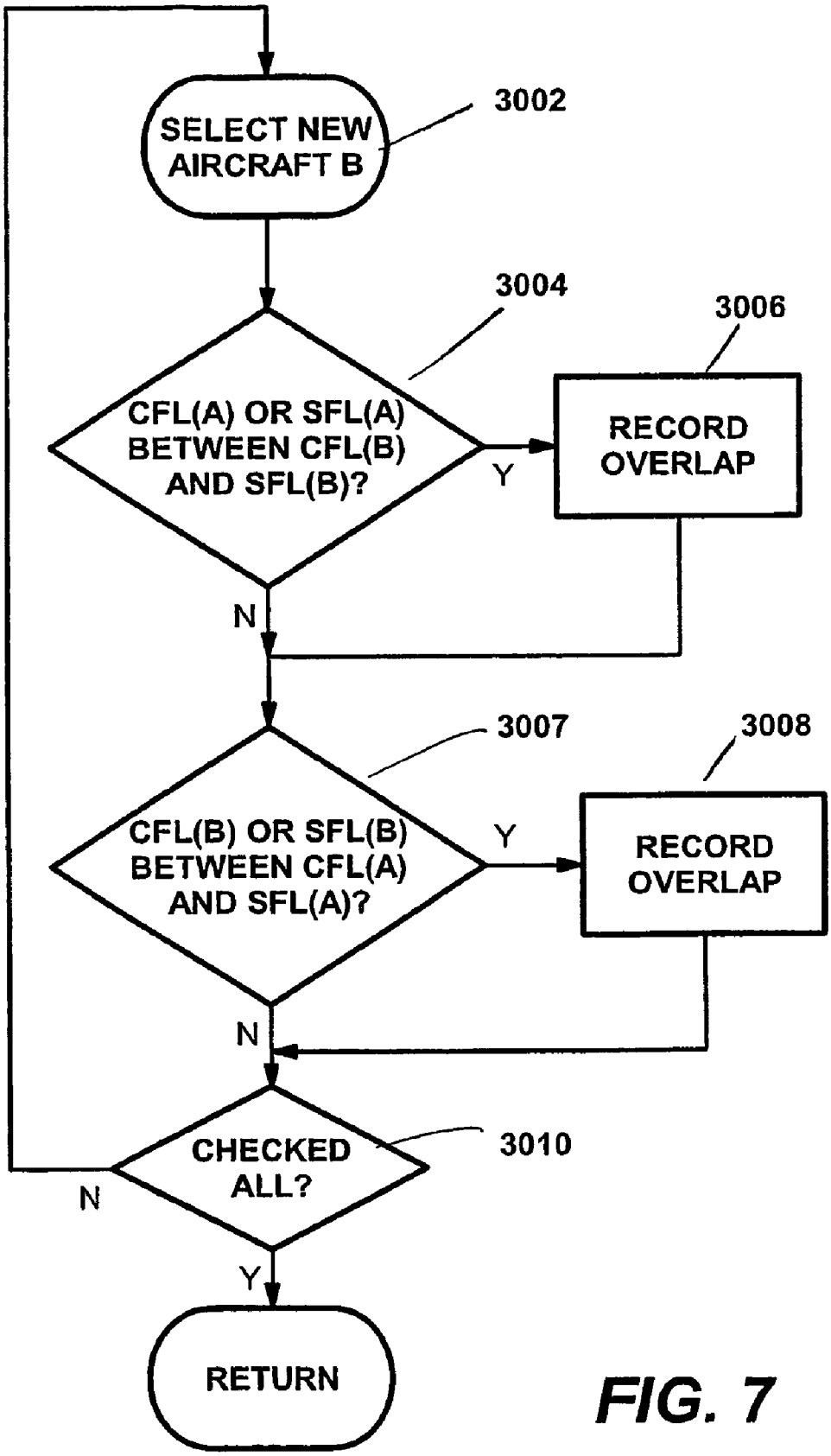
FIG. 7 is a flow diagram showing in greater detail part of the process of FIG. 6 for determining the existence of overlapping altitudes.

In step 2014, the computer 108 reviews the records of the other aircraft in the stack list, to check for altitude conflict as described in greater detail in FIG. 7. Where there is no overlap (step 2016) the computer returns to await the next selected flight level data.

Referring to FIG. 7, the overlap detection process is as follows. In step 3002, the computer 108 selects a first aircraft from the list (indicated in FIG. 7 as "Aircraft B"). In step 3004, the selected flight level and the current flight level of the test aircraft ("Aircraft A"), for which the new selected flight level or current flight level was read, are compared with the current flight level and selected flight level of the selected reference aircraft (Aircraft B) the computer by 108. If the current flight level or selected flight level of the test aircraft A fall between the current flight level and selected flight level of aircraft B, then (step 3006) an overlap is found to be present.

It should be emphasised that this does not indicate with certainty that the aircraft will come close to each other in altitude. For example, if both are descending at the same rate, the higher aircraft may descend into the flight level currently occupied by the lower only after the lower has vacated it, so that separation is maintained. However, as the rates of climb and descent of the aircraft cannot be predicted with certainty by the controller, he cannot rule out the possibility that the two aircraft will share the same altitude.

Figure 6B:
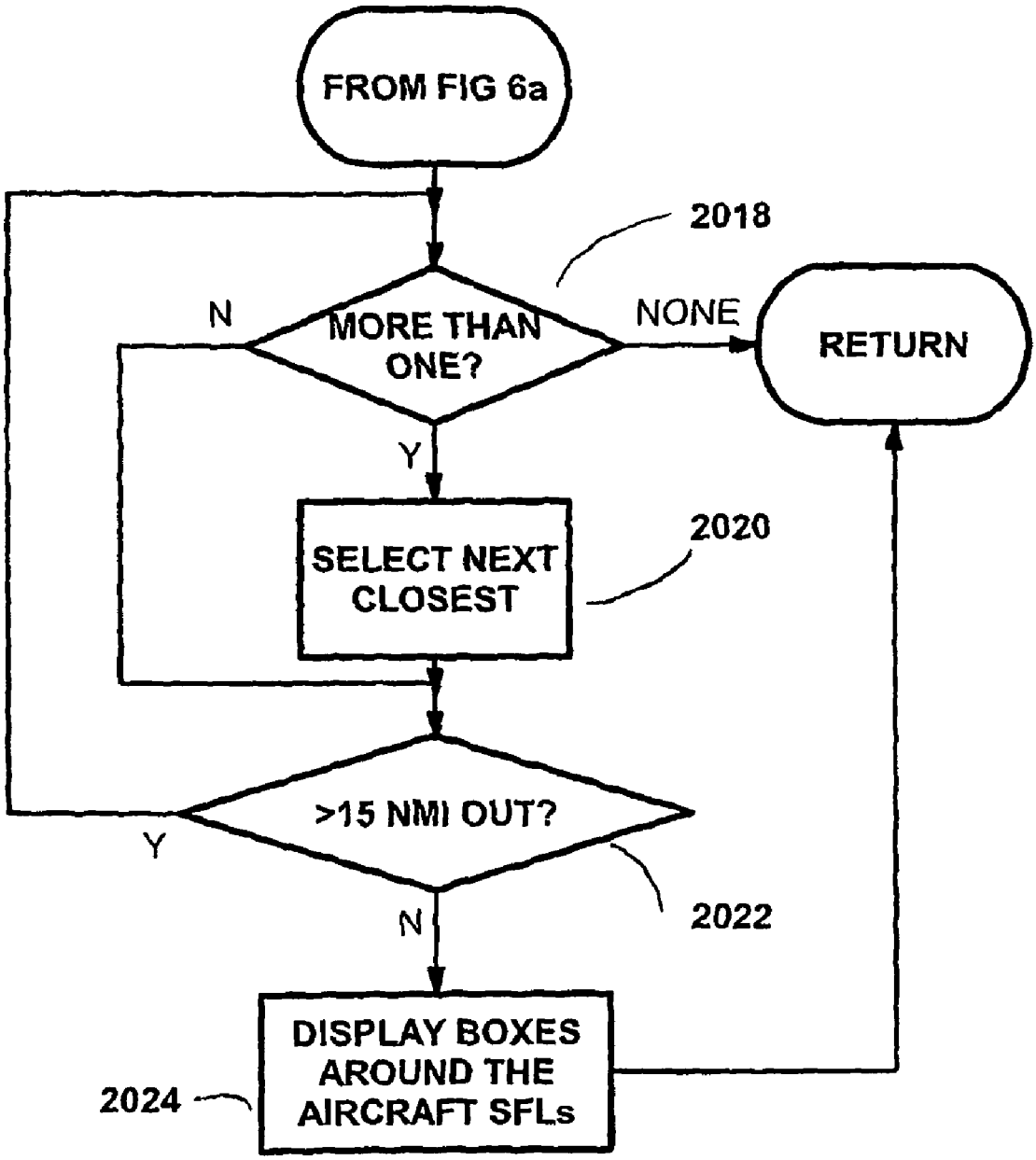
Figure 8:
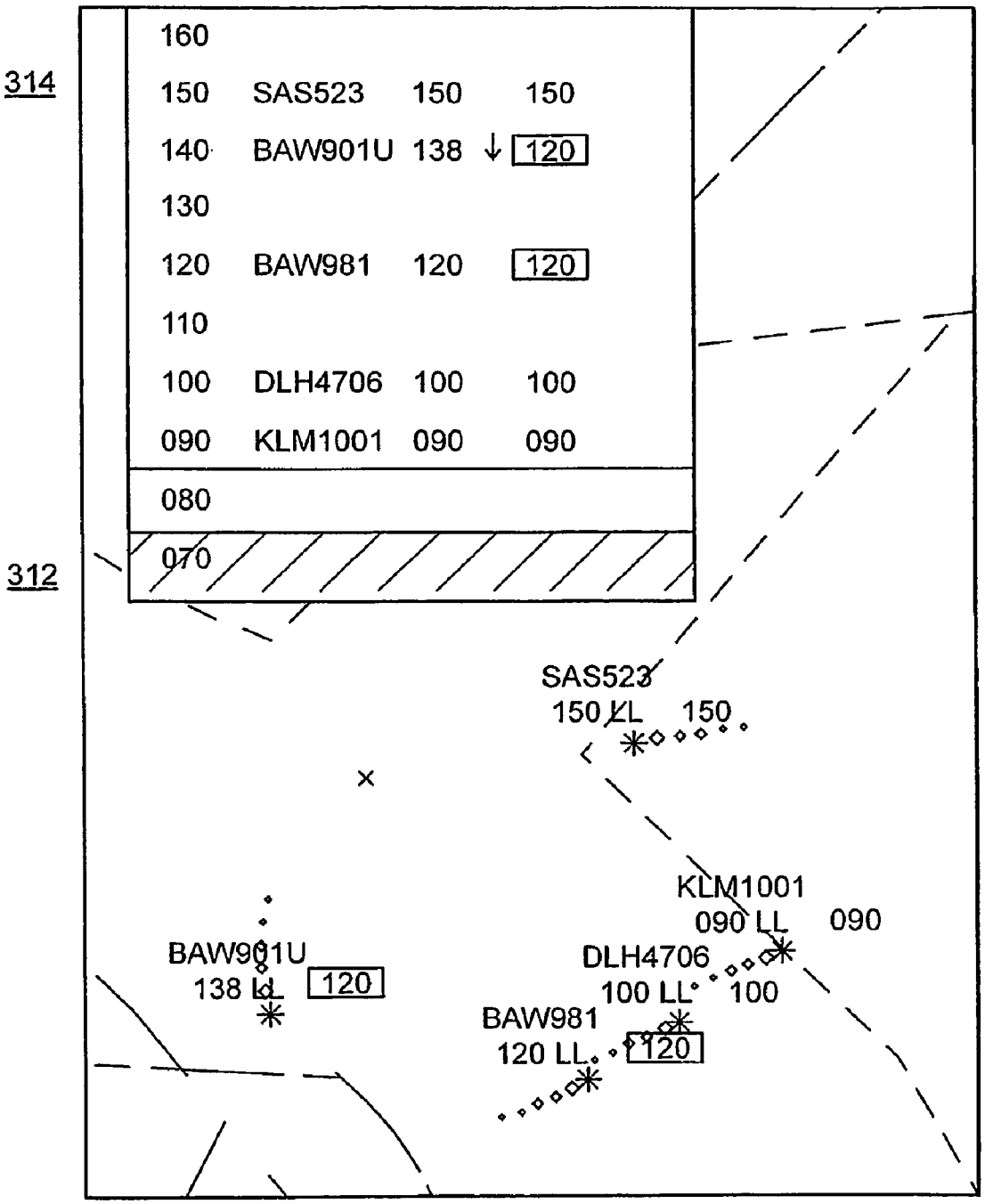
FIG. 8 shows a screen display corresponding to that of FIG. 4 in the case of aircraft with overlapping altitudes.

Likewise in step 3007, the computer 108 reverses the test, to determine whether the current flight level or selected flight level of the reference aircraft B fall between the current flight level and selected flight level of the test aircraft A and, if so, determines the presence of an overlap in step 3008. The computer 108 then checks (step 3010) whether all aircraft in the list have been examined and, if not, returns to step 3004 to select the next reference aircraft B for comparison.

Where all aircraft have been examined (step 3010) the overlap determination process of FIG. 7 returns, and the computer 108 proceeds to execute the steps of FIG. 6*b*. Referring to FIG. 6*b*, in step 2018, computer 108 determines whether overlaps were found with more than one of the other aircraft on the stack list and, if so, in step 2020, the computer 108 selects from them the aircraft which is closest in altitude. In step 2020, the computer 108 performs an azimuthal position check, to determine whether that aircraft is more than 15 nautical miles from the stack reference point and, if so, that aircraft is ignored and the computer 108 selects the next closest once more in step 2020.

Where (step 2018) only a single aircraft is found to overlap or (step 2022) the closest in altitude (which is azimuthally close to the stack) has been selected, the display screen shown in FIG. 4 is updated as shown in FIG. 8. In the updated screen, a visual representation is displayed, connecting the test aircraft (i.e. that for which CFL or SFL data has just be acquired) with the selected overlapping aircraft. In the display line for each aircraft, the current flight level and selected flight levels are also displayed.

In this embodiment, for each of the two aircraft, representation linking the two aircraft is realized by highlighting them; conveniently, the colour of the selected flight level indication is changed (e.g. to white) and a symbol (e.g. a box as shown in FIG. 8, or a box with the lowest side missing as shown in FIG. 9) is drawn around each of the two selected flight levels of the two overlapping aircraft. Thus, even with other aircraft falling between, the controller can readily pick out the pair of aircraft where the overlap is predicted. If an aircraft overlaps with two other aircraft which are at the same level (within the minimum resolution of their altimeter transponders, e.g. 25 or 100 feet), then both are highlighted in this way as shown in FIG. 9.

EFFECTS OF THE INVENTION

It will be clear that is advantageous to the controller to have a vertical stack list display in which aircraft are automatically ranked by their current altitude, as measured. It has been possible for many years to measure the altitude of aircraft ("Mode-C altitude") by interrogating transponders on the aircraft, but the advent of Mode-S interrogation makes such altitude measurements more reliable as multiple aircraft can more reliably be separated.

The advent of enhanced Mode-S radar also enables interrogation of selected flight levels, and once this data is displayed, the controller has sufficient knowledge to determine altitude overlaps. However, the process of determining each possible altitude overlap between tens of aircraft held in a vertical stack list, when the data for each aircraft is updated every few seconds, is beyond the abilities of a human air traffic controller who must make split second decisions to maintain the safety of all the aircraft under his control.

It would be possible merely to automate the determining of overlaps, and present the controller with the information, but to do so would often lead to information overload which would equally make it impossible for the controller to grasp the situation and effect timely control of the aircraft in the stack. For example, where one aircraft towards the top of the stack has selected a future flight level indicating that it will descend to the bottom, it will overlap the altitudes of all other aircrafts in the stack (and likewise, an aircraft at the bottom rising through the stack will produce the same effect). The total number of conflicts which would thus be indicated to the controller by such a system which be very high.

Accordingly, the present embodiment adopts a graphical display to convey information graphically to the controller. It has been found, after extensive testing, that the presently described embodiment enables the controller to operate without information overload. Preferably, as indicated above, the system selects the closest aircraft in altitude, in the direction in which the aircraft concerned is travelling, and displays only the overlap with that aircraft. It may also overlap with several others later on, but the air traffic controller will, on being notified of the closest (and hence the most imminent) overlap, take preventative action which will usually also deal with all the other overlaps. Since, however, the stack may include aircraft from outside the stack volume, which have been manually included for completeness, overlaps with any such aircraft currently outside the stack volume are ignored.

Some aircraft may be equipped with only basic Mode-S equipment which cannot relay the selected flight level (at least, over the few years). In such cases, some level overlap information is still calculated as the current flight level of the aircraft can be compared with the selected flight levels of others. Such aircraft may be displayed in a different colour, otherwise visually distinguishable, to enable the controller to see why no selected flight level is displayed for them.

Thus, according to the above described embodiments, when an aircraft changes its selected flight level, the controller is able to see potential altitude overlaps and hence possible close approaches of aircraft, by a graphical alert indicating the closest or most imminent such overlap, enabling him to choose whether or not to take action to avoid such overlap.

The controller is not obliged to do so, as an altitude overlap does not indicate a necessarily dangerous situation. If he takes no such action, the overlap may later disappear (for example, if both aircraft which are overlapping in altitude ascend or descend at the same time to new levels). If, on the other hand, the aircraft approach in altitude and also in geographical position, the controller will in due course receive a short term conflict alert (STCA) as is conventional in air traffic control systems, enabling him to instruct evasive action.

The present invention therefore neither aims to detect all close approaches nor guarantees their elimination. It merely aims to provide a graphical user interface enabling the air traffic controller to visualise the aircraft in the stack, and their indicated intentions, to allow him to manage the stack more efficiently.

OTHER VARIANTS AND EMBODIMENTS

Although embodiments of the invention have been described above, it will be clear that many other modifications and variations could be employed without departing from the invention. For example, other visual representations could be used to visually link overlapping altitude aircraft, such a linking line drawn between the display lines of the two aircraft. Whilst a test based on proximity to the stack reference point is used to exclude aircraft from being displayed, other azimuthal position tests (based for example on the azimuthal distance between the projected tracks of the two aircraft) could be used.

The rule for selecting the defined volume for populating the stack could take different forms, and in particular, where the approach and departure directions for aircraft are different, the defined volume could have a different definition for arriving and departing aircraft (for example, one being offset from the other).

Whilst particular units, dimensions, spacings and measurement systems are described, which are appropriate to present-day Heathrow airport, these could easily be changed to others appropriate to other airports and control regimes.

Whilst the workstations are described as performing the human machine interface and receiving and transmitting data to the host computer, "dumb" terminals could be provided (all calculation being performed at the host). In general, calculations can be performed either at distributed terminals or at a central computer, although the described embodiment is found to provide a suitable load balance given present-day equipment. Many other modifications will be apparent to the skilled person, and the present invention extends to any and all such modifications and embodiments.

The present invention is useable with the features of our co-pending PCT application, PCT/GB2007/002449, filed on the same day as the present application, claiming priority from UK patent application GB0613055.3, agents' reference J00048914WO.

The invention claimed is:

1. An air traffic control system, for use by a controller controlling a plurality of aircraft held vertically separated in a stack, the system comprising at least one processor;

a display device for the control generating a display controlled by said at least one processor, and at least one device for selectively receiving, from said aircraft, an indication of their intended future altitudes;

characterised in that said processor is arranged to receive such intended altitude data;

to compare said intended altitude data with current altitude and/or intended altitude data of other aircraft; and to generate said display on said display device so as to list said plurality of aircraft, to highlight a first part of the display relating to a first aircraft whose intended altitude overlaps with the current or intended altitude of at least one said second aircraft, and to highlight also a second part of the display relating to said second aircraft.

2. A system according to claim 1 in which, when the intended altitude of said first aircraft overlaps with altitudes of a plurality of said second aircraft, said processor is arranged to selectively highlight only a subset of said second aircraft.

3. A system according to claim 2 in which the processor is arranged to highlight only a single said second aircraft or, where a plurality of said second aircraft occupy a single unique altitude, all of said second aircraft occupying said single altitude.

4. A system according to claim 1, wherein said aircraft are displayed in a vertical list on said display device, ranked according to their current altitudes.

5. A system according to claim 1 in which said display indicates a plurality of flight levels as a plurality of slots each for accommodating an aircraft separated from its neighbours by a minimum height spacing.

6. A system according to claim 5 in which said slots define a height spacing of 1000 feet.

7. A system according to claim 1 further comprising at least one radar station equipped with a transponder for interrogating each said aircraft.

* * * * *